US009920738B2

(12) United States Patent
Gallatz et al.

(10) Patent No.: US 9,920,738 B2
(45) Date of Patent: Mar. 20, 2018

(54) METHOD AND DEVICE FOR INTRODUCING MICROWAVE ENERGY INTO A COMBUSTION CHAMBER OF AN INTERNAL COMBUSTION ENGINE

(71) Applicant: MWI Micro Wave Ignition AG, Empfingen (DE)

(72) Inventors: Armin Gallatz, Empfingen (DE); Volker Gallatz, Sulz-Bergfelden (DE); Arnold Moebius, Bremen (DE); Manfred Thumm, Linkenheim-Hochstetten (DE)

(73) Assignee: MWI Micro Wave Ignition AG, Empfingen (DE)

( * ) Notice: Subject to any disclaimer, the term of this patent is extended or adjusted under 35 U.S.C. 154(b) by 118 days.

(21) Appl. No.: 15/043,538

(22) Filed: Feb. 13, 2016

(65) Prior Publication Data

US 2016/0265504 A1 Sep. 15, 2016

(30) Foreign Application Priority Data

Mar. 3, 2015 (EP) ..... 15157321

(51) Int. Cl.
*F02B 19/00* (2006.01)
*F02P 23/04* (2006.01)
(Continued)

(52) U.S. Cl.
CPC ..... *F02P 23/045* (2013.01); *F02F 1/24* (2013.01); *F02P 15/02* (2013.01); *F02P 15/04* (2013.01); *F02P 15/08* (2013.01)

(58) Field of Classification Search
CPC ..... F02P 23/045; F02P 15/02; F02P 15/08; F02M 27/00; F02M 27/04; F02F 1/24
See application file for complete search history.

(56) References Cited

U.S. PATENT DOCUMENTS 4,561,406 A 12/1985 Ward
2009/0229581 A1* 9/2009 Ikeda ..... B01D 53/32 123/536

(Continued)

FOREIGN PATENT DOCUMENTS

DE 10356916 A1 6/2005
DE 102011116340 5/2013

(Continued)

*Primary Examiner* — Hai Huynh
*Assistant Examiner* — Gonzalo Laguarda
(74) *Attorney, Agent, or Firm* — Von Rohrscheldt Patents

(57) ABSTRACT

A method for introducing microwave energy into a combustion chamber of an internal combustion engine in which the microwaves reach a combustion chamber through a microwave window, wherein the microwaves are run about a circumference of the combustion chamber and radially coupled into the combustion chamber after passing through the microwave window. Accordingly a device for introducing microwave energy into the combustion chamber of a reciprocating piston internal combustion engine with at least one cylinder with a cylinder head and a combustion chamber in the cylinder includes at least one circumferential annular hollow conductor cavity extending about the combustion chamber and including at least one feed for the microwave and at least one outlet opening for the microwave arranged between the annular hollow conductor cavity and the combustion chamber. An internal combustion engine includes the features of the device.

14 Claims, 10 Drawing Sheets

(51) Int. Cl.

| | |
|---|---|
| ***F02F 1/24*** | (2006.01) |
| *F02P 15/04* | (2006.01) |
| *F02P 15/02* | (2006.01) |
| *F02P 15/08* | (2006.01) |

(56) References Cited

U.S. PATENT DOCUMENTS

| | | | | |
|---|---|---|---|---|
| 2010/0236511 | A1* | 9/2010 | Elkanick | F02B 5/00 123/1 A |
| 2011/0030660 | A1 | 2/2011 | Ikeda | |
| 2014/0014050 | A1* | 1/2014 | Ikeda | F02P 9/007 123/3 |
| 2014/0216381 | A1* | 8/2014 | Ikeda | H05H 1/46 123/143 B |
| 2016/0265503 | A1* | 9/2016 | Gallatz | F02F 1/24 |

FOREIGN PATENT DOCUMENTS

| | | | |
|---|---|---|---|
| EP | 2065592 | A1 | 6/2009 |
| EP | 2687714 | A2 | 2/2014 |

* cited by examiner

METHOD AND DEVICE FOR INTRODUCING MICROWAVE ENERGY INTO A COMBUSTION CHAMBER OF AN INTERNAL COMBUSTION ENGINE

RELATED APPLICATIONS

This application claims priority from and incorporates by reference European Patent Application 15 157 321.9 filed on Mar. 3, 2015.

FIELD OF THE INVENTION

The invention relates to a method for introducing microwave energy into a combustion chamber of a reciprocating piston internal combustion engine and a device for introducing microwave energy into a combustion chamber of a reciprocating piston internal combustion engine with at least one cylinder with a cylinder head and a combustion chamber where the microwaves propagate into the combustion chamber through a microwave window. The invention also relates to an internal combustion engine with the device.

BACKGROUND OF THE INVENTION

DE 103 56 916 A1 discloses to generate a space ignition in a combustion chamber in an internal combustion engine in order to better ignite and combust a fuel air mixture of an introduced fuel.

In conventional engines an ignitable mixture is compressed in a cone shaped cylinder head and caused by a spark plug to react and oxidize. Thus, a chemical oxidation spreads cone shaped from an ignition location as a pressure and reaction front (laminar combustion gas phase). The pressure front moves faster than the reaction front and therefore reaches a cylinder edge first. The pressure front is reflected at the cylinder edge and runs towards the reaction front. When both fronts meet the reaction can die down which degrades efficiency and causes pollutants.

Replacing the local ignition by a space ignition through microwaves mitigates this effect. Before ignition the mixture shall be excited over the entire volume as homogeneously as possible which requires absorption that is distributed over the combustion chamber. Thus, an absorption capability for microwaves described by a material parameter tan $\delta$ (t) and an associated penetration depth are important.

During compression a pressure and temperature dependent ionization of the mixture to be ignited is already being performed. Due to this ionization of particular fuel molecules absorption rates of the microwaves by the ignitable mixture in the combustion chamber have to be expected which, however, vary time based over the compression process.

Since the described homogeneity can never be achieved entirely in practical applications the reaction front shall run from an outside in inward direction. Therefore a microwave feed has to be found which generates a field distribution in the circular cylindrical combustion chamber wherein the field distribution increases homogeneously along the entire circumference and increases as homogeneously as possible along a radius or advantageously monotonously increases for larger radii. The homogeneity of the field distribution shall be rendered as independent as possible from absorption properties of the mixture.

BRIEF SUMMARY OF THE INVENTION

Thus, it is an object of the invention to achieve an ignition distribution in the entire combustion cavity that is a homogeneous as possible, or to generate local ignition cores at least in an edge portion of the combustion chamber.

The object is achieved according to the invention through a method for injecting microwave energy into a combustion chamber of an internal combustion engine including the steps passing microwaves through a microwave window of an internal combustion engine; running the microwaves about a circumference of a combustion chamber after passing the microwaves through the microwave window: and radially injecting the microwaves into the combustion chamber after running the microwaves about the circumference of the combustion chamber.

The object is also achieved by a device for injecting microwave energy into a combustion chamber of an internal combustion engine including at least one cylinder with a cylinder head and a combustion chamber, wherein microwaves are injected through a microwave window into the combustion chamber, wherein the cylinder head includes at least one circumferential annular hollow conductor cavity circumferentially extending about the combustion chamber and including at least one feed for the microwaves and at least one outlet opening for the microwaves arranged between the at least one circumferential annular hollow conductor cavity and the combustion chamber. The object is also achieved by an internal combustion engine including the device recited supra.

Accordingly the method according to the invention runs the microwaves along the circumference of the combustion chamber after passing through the microwave window and injects them radially into the combustion chamber. The microwave window closes the combustion chamber to an outside and is thus used for sealing and simultaneously facilitates injecting the microwaves. The microwave window can be made for example from a solid temperature stable material, advantageously a ceramic material with a purity>99% or another solid material that is microwave permeable with respective properties in order to degrade the microwaves as little as possible. For example sapphire glass or quartz glass can be used for this purpose. The microwaves can thus be run only in one plane or also in various planes in opposite directions or in identical directions about the combustion chamber and can be injected into the combustion chamber through the combustion chamber wall.

Advantageously the microwaves are injected into the combustion chamber through at least one annular hollow conductor cavity arranged at the circumference of the combustion chamber wherein the hollow conductor cavity includes at least one outlet opening oriented towards the combustion chamber. Thus, the microwaves are introduced into an annular hollow conductor cavity providing optimum wave conduction while avoiding mode leaps and reflections wherein a cross section of the all annular hollow conductor cavity can be rectangular, especially square, circular or oval. The cross section is advantageously square in order to prevent flash overs in the annular hollow conductor cavity. The annular hollow conductor cavity can either be arranged directly adjacent to the combustion cavity wall or as recited supra in the combustion cavity wall so that the microwaves which radially exit through at least one outlet opening in the annular hollow conductor cavity in a direction towards the combustion chamber are directly injected through the microwave window into the combustion chamber. The at least one outlet opening can thus extend over an entire circumference of the combustion chamber or also only over only portions thereof.

Advantageously the microwaves are conducted at an end of the annular hollow conductor cavity into the combustion chamber at an angle in order to prevent reflections of the microwaves that have already run around the combustion chamber at an end of the annular conductor cavity back to a microwave source or in order to at least substantially mitigate those reflections.

Advantageously the microwaves are introduced from the annular hollow conductor cavity through a circumferential gap between the annular hollow conductor cavity and the combustion chamber wall which gap increases with a length of a path of the microwaves in the hollow conductor cavity or through a plurality of gaps advantageously increasing in size with a length of the path of the microwave in the annular hollow conductor cavity wherein the gaps are arranged perpendicular to a propagation direction of the microwaves between the annular hollow conductor cavity and the combustion chamber wall or a combination thereof. These measures are used to concentrate microwave energy in sufficient quantity at a maximum number of locations in the combustion chamber in order to generate a space ignition in the combustion chamber through a plurality of ignition cores.

Advantageously the microwaves are introduced with a frequency of 25 GHz to 90 GHz, advantageously 36 GHz since it has become apparent that these frequencies generate the desired space ignition in the combustion cavity.

It is furthermore advantageous when the microwaves are introduced in impulse packets including microwaves emitted in a duty cycle wherein the impulse packets are advantageously also maintained after an ignition of a fuel air mixture has already been performed. Thus, the ignition of the fuel air mixture is optimized and the combustion of the fuel air mixture is further excited even after the ignition has already been performed and the combustion chamber may already be expanding.

It is a particular advantage of the method that the microwaves are introduced as function of crank shaft angle degrees so that a precise control of the ignition can be performed.

In the device according to the invention for introducing microwave energy into the combustion chamber of the reciprocating piston internal combustor engine with at least one cylinder with a cylinder head in which the microwaves are introduced through a microwave window into the combustion chamber the cylinder head includes at least one annular hollow conductor cavity extending about a circumference of the combustion chamber and including at least one feed for the microwave and at least one outlet opening for the microwave arranged between the annular hollow conductor cavity and the combustion chamber.

Advantageously in order to avoid reflections at an end of the annular conductor cavity a wall is arranged at this location that is disposed at an angle relative to the annular hollow conductor cavity and an outlet opening in a direction towards the combustion chamber wall.

The device advantageously includes a circumferential gap between the annular hollow conductor cavity and the combustion chamber wall, wherein the gap increases in size with the length of the path of the microwave in the annular hollow conductor cavity or the device includes a plurality of gaps that advantageously increase in size with the length of the path of the microwave in the annular hollow conductor cavity and that are arranged perpendicular to the propagation direction of the microwave between the annular hollow conductor cavity and the combustion chamber wall or a combination thereof.

In order to provide the device according to the invention with a cost effective configuration the annular hollow conductor cavity is configured as a channel extending about the combustion chamber with a ring that is insertable onto the channel in order to form the hollow conductor. The ring covers the channel on an open side in a simple manner and facilitates fabrication. Advantageously the ring can include points that extend into the combustion chamber so that local field augmentations trigger an increased amount of ignitions at these locations.

This ring is particularly advantageous when the an additional, advantageously identical hollow conductor cavity is provided according to another advantageous embodiment of the device according to the invention adjoining the first annular hollow conductor cavity wherein the additional annular hollow conductor cavity is for example advantageously arranged with outlet openings that are offset relative to the outlet openings of the first annular hollow conductor cavity and wherein the additional annular hollow conductor cavity is advantageously arranged in an annular component which is arranged adjoining the first annular hollow conductor cavity with the hollow conductor cavity of the annular component oriented in an opposite direction. Then an annular divider plate can be arranged between the work piece and the other hollow conductor cavity which forms a divider wall between the hollow conductor cavities and simultaneously forms a wall for both annular hollow conductor cavities. On the one hand side it is facilitated by this configuration to inject opposite microwaves into the respective annular hollow conductor cavities and to inject microwaves into the combustion chamber through offset arrangements of the outlet openings in order to generate as many ignitions cores as possible to provide a space ignition.

Additionally points for local field augmentation and generation of ignition cores can be provided in the combustion cavity, in particular in the cylinder head. If necessary at least one additional microwave spark plug according to the co-owned application EP 15 15 72 98.2 can be arranged in the cylinder head.

The internal combustion engine according to the invention is configured as reciprocating piston internal combustion engine and includes a device recited supra according to one of the embodiments recited supra The mathematical description of the injection is based on a cylinder coordinate system r, φ, z. In a circular cylindrical space that is defined with electrically conductive borders a distribution of the electromagnetic waves along the circumference is defined by sine or cosine functions and defined by cylinder functions also designated Bessel functions along the radius. Depending on an orientation of the field lines the associated Eigen modes are designated $TE_{mn}$ $TM_{mn}$ modes. Thus, the first index m corresponds to the number of azimuthal maxima, the second index n corresponds to the number of radial maxima. Modes with high azimuthal index and low radial index are designated as Whispering Gallery Modes WGM. Their power oscillates substantially at an edge of the hollow cylinder. With increasing radial index the oscillating power moves into the interior of the combustion chamber.

A superposition of two modes that are offset by π/(2m) azimuthally and time based but which are identical otherwise lead to a rotating mode. These are quite well known in literature. Mathematically an azimuthally standing mode is expressed by two counter rotating modes using the following equation:

$$2\cos m\varphi e^{-i\omega t}=(e^{im\varphi}+e^{-im\varphi})e^{-i\omega t}$$

In case m=0 there is an azimuthally constant distribution.

A similar equation applies in radial direction. The Bessel function describing radially standing waves can be broken down into inward and outward propagating Hankel functions:

$$2J_m(k_r r)=H_{m2}(k_r r)+H_{m1}(k_r r)$$

wherein kr is the radial wave number. A field distribution proportional to $$e^{im\varphi}*H_{m2}(k_r r)$$

describes a mode whose power propagates inward in a spiral shape. The associated face fronts become steeper and steeper with decreasing radius.

According to the invention an ignition with maximum homogeneity along the circumference is optionally achieved in an outer portion of the cylinder or in the entire volume in that either a rotating Whispering Gallery Mode or a volume mode is excited in the combustion cavity in a controlled manner. Thus, a feed wave conductor, advantageously a rectangular wave conductor in the form of the annular hollow conductor cavity is wound about the combustion chamber. From theory it is known that the hollow conductor wave length of its modes can be changed by the transversal geometric dimensions. The feed wave conductor and the cylindrical combustion cavity are therefore connected with each other in one embodiment by periodic openings through the combustion cavity wall acting as microwave window which injects power from the wave conductor into the combustion cavity. Now the period p of the openings is selected so that $$p = \frac{2*\pi}{k_i}$$

wherein $k_i$ is the axial wave number of the mode in the wound wave conductor which excites a T $E_{on}$ mode in the combustion chamber in a controlled manner. This mode in an ideal case would have circular inward running face fronts with constant amplitude. The fed in power reaches the opposite wall directly and can already be injected back into, the wound feed wave conductor at this location. The covered path length in the combustion cavity thus corresponds to a diameter of the combustion cavity. In case of bad absorption of the mix to be ignited a considerable portion of the power is injected back into the feed wave conductor and reflected to the microwave source.

Therefore a slightly different period of the openings is selected as an alternative according to the invention. Thus, the face fronts are inclined. The power propagates in a spiral shape into the combustion cavity which facilitates a high path length and thus an absorption of the microwave power that is largely independent from tend. The width of the openings is varied so that the power injected into the combustion chamber is constant along the circumference.

As described supra the surfaces with constant phase are inclined the more relative to the radius, the smaller the radius becomes. There is a radius at which the power only propagates in the azimuthal direction. This leads to a portion without field in an interior of the combustion chamber. This is advantageous when a fuel concentration is low in a center of the combustion chamber. The excited modes correspond to the already recited Whispering Gallery Modes. This coupling is reached in a particularly efficient manner when the wave length in the wound wave conductor is shortened relative to the clear space wave length. Thus, the wave conductor is filled with a non absorbing dielectric material.

On a path from a source to the combustion chamber the microwaves nave to overcome windows that are configured as pressure barriers. The dielectric material in the wound/cambered wave conductor can be used as a microwave window according to the invention.

It can be advantageous to augment ignition at the hollow conductor wall. From electromagnetic wave theory it is known that resonant field augmentations can form in introduced dielectric materials. This can be provided for example by a ring thus designated "ignition ring" wherein the local resonant field augmentation also reaches into the combustion chamber and augments ignition at this location.

According to the invention the ignition rings can additionally perform the function of the window. When these rings shall only be used as a window without ignition function they are advantageously arranged in the space outside the bars. This yields no field augmentation at the edge Strong field augmentations can be obtained at the edge with simultaneously comparatively weaker excitation of the field in a center in that the in injecting period is selected so that injection is performed into a volume mode as well as into a WGM. This yields a field augmentation in edge portions.

The excitation of the fields at an edge of the combustion chamber can also be controlled time based. Initially a frequency is selected at which an injection is performed by the feed wave conductor into the volume mode exciting the entire combustion chamber. The frequency can be changed subsequently so that an injection is performed into an igniting WGM.

At an end of the wound wave conductor a plate can be arranged that is inclined by an angle of 45° and that rotates the polarization The microwave power reaching the end of the wound conductor is then reflected in a rotated polarization. The power injected into the combustion cavity in the 90° rotated polarization does not interfere with the power injected in forward direction then.

In some applications it can be required to augment the ignition locally at a slant of the cylinder head. From electromagnetic wave theory it is well known that local field augmentation advantageously occurs at conductive points. When these conductive points are arranged at different locations in the engine (cylinder head) local field augmentations and thus local ignitions are obtained.

The method and the combustion engine thus facilitate precise control of a beginning of a space ignition of a fuel air mixture in a combustion chamber so that an optimum low emission combustion of the fuel is achieved with increased efficiency compared to conventional reciprocating piston internal combustion engines. Typically the invention facilitates safe ignition of lean fuel air mixtures which does not require additional enrichment for achieving ignition and which leads to a lower fuel consumption. Emissions and their generation can be controlled by the combustion temperature and the mix ratio of air and fuel. Combustion according to the invention occurs faster than for conventional ignitions. This causes "colder" combustion so that the efficiency increases. Furthermore lower pollutant emissions are achieve able through colder combustion processes as a matter of principle. The colder combustion reduces the concentration of NO in the exhaust gases. Through space ignition the combustion process, differently from conventional combustion is much less dependent on combustion progress in the form of diffusion flames. This helps to avoid additional heat losses and achieves an efficient increase. A heat up phase of the combustion chamber and of the air in the oxidation portion is not provided for this type of combustion.

BRIEF DESCRIPTION OF THE DRAWINGS

The invention is subsequently can be described in more detail with reference to schematic drawing figures. Additional features of the invention can be derived from the subsequent description in combination with the patent claims and the appended drawing figures, wherein:

DETAILED DESCRIPTION OF THE INVENTION

Figure 1A:
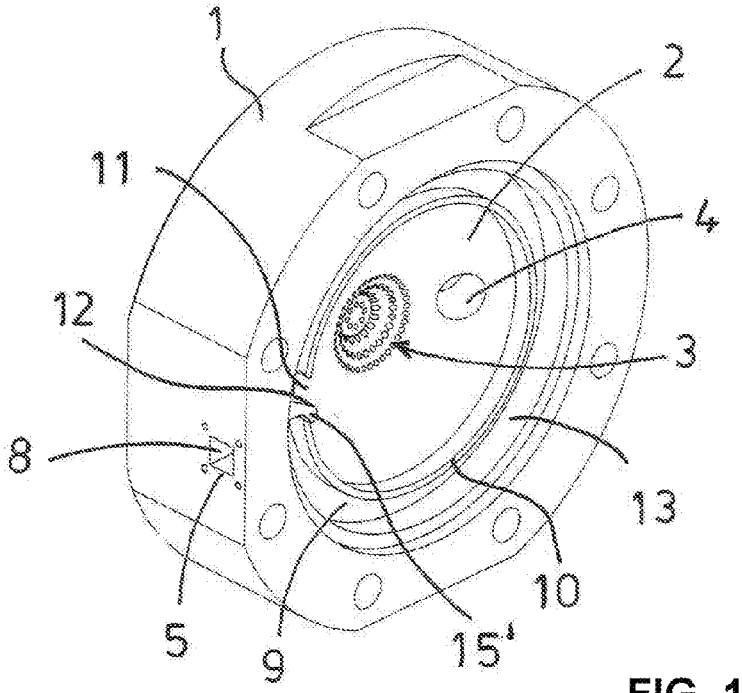
FIG. 1A illustrates a cylinder head with ring injection with a constant slot in a perspective view.

In the subsequently described figures the invention is illustrated in an exemplary manner based on various embodiments. Identical or like elements in the individual figures are provided with identical reference numerals.

Figure 5A:
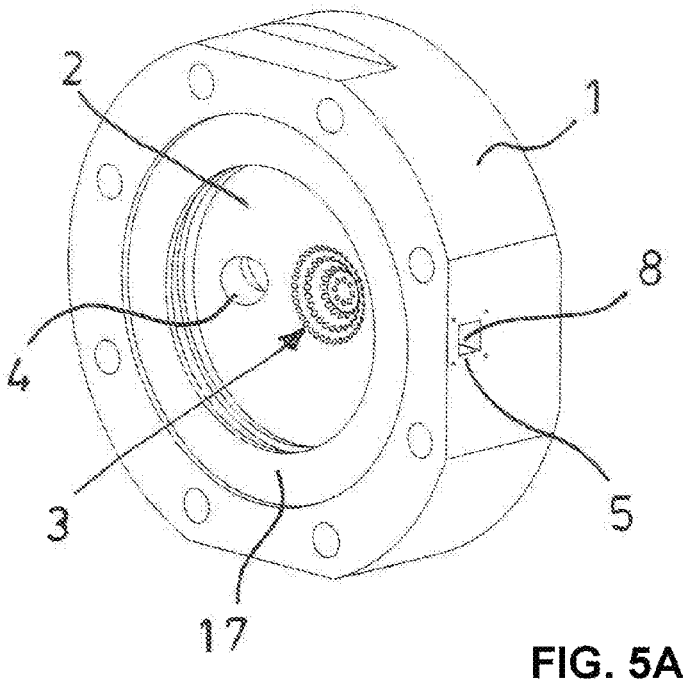
FIG. 5A illustrates a cylinder head according FIG. 2 in which an annular hollow conductor cavity with an enlarging opening is formed by an inserted cover ring in a perspective view.
Figure 5B:
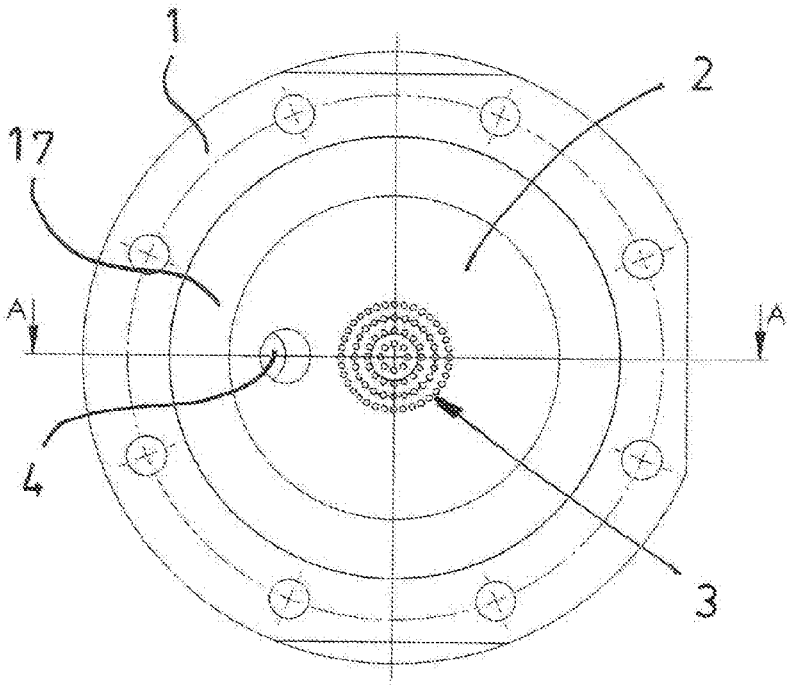
FIG. 5B illustrates a cylinder head according FIG. 2 in which an annular hollow conductor cavity with an enlarging opening is formed by an inserted cover ring in top view.
Figure 5C:
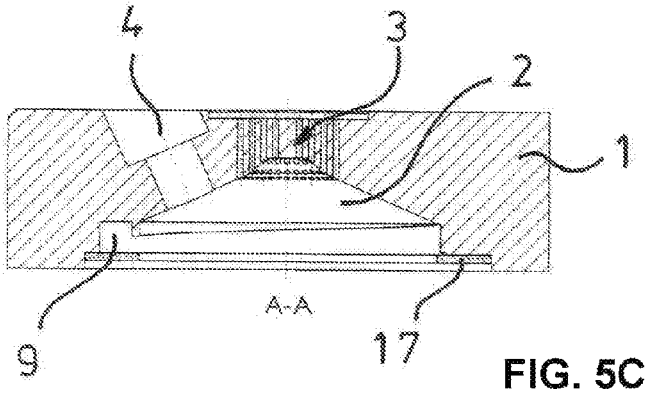
FIG. 5C illustrates a cylinder head according FIG. 2 in which an annular hollow conductor cavity with an enlarging opening is formed by an inserted cover ring in a sectional view.

FIG. 1A illustrates a perspective view of a cylinder head 1 made from metal that includes a cambered combustion chamber 2. In this embodiment a plurality of bore holes 3 leads into the combustion chamber 2, wherein the bore holes are arranged in a center of the combustion chamber 2 and a fuel air mixture can be introduced through the bore holes. The exhaust gases are let out in a manner that is typical for engines of this type. It is appreciated that an inlet valve or an outlet valve can be arranged in the cylinder head 1 in a customary manner. This embodiment includes an additional bore hole 4 into which an additional spark plug can be inserted if necessary. When sufficient microwave energy is introduced and a space ignition is accordingly achieved in the combustion chamber 2, this bore hole can also be omitted. The cylinder head 1 includes an opening 5 at its circumference in which or in front of which a microwave window 6 is arranged that is illustrated in an exemplary manner in FIG. 7 in order to separate the combustion chamber 2 from the space arranged outside of the cylinder so that no gases can move through this path back into a microwave feed illustrated in FIG. 7. The opening 5 is an end of a cavity 8 which leads into an annular cavity 9 which extends about the combustion chamber 2. As apparent from the figures the annular cavity 9 is configured as a channel in the cylinder head 1 wherein the channel becomes an annular hollow conductor cavity by using a ring 17, 17' which will be illustrated infra with reference to FIGS. 5 and 6. Therefore this cavity is designated in the open illustration as an annular cavity 9 and in the closed illustration as annular hollow conductor cavity 9. A bar 10 enveloping the combustion chamber 2 forms the wall of the annular conductor 9 towards the combustion chamber 2. The bar 10 includes an opening 11 at an end of the hollow conductor cavity 9 wherein the opening connects the annual cavity 9 with the combustion chamber 2. Additionally the face wall 12 arranged at an end of the annular cavity 9 is configured at a slant angle so that the microwaves extending in the annular cavity 9 impact the face wall 12 at an angle so that they are not reflected back by the annular cavity 9 or only reflected back to a small extent. Instead the microwave running through the annular cavity 9 can exit through the opening 11 into the combustion chamber. In the embodiment illustrated in FIG. 1 the wall forming bar 10 has a continuously constant height which is lower than the circumferential outer wall 13 about the channel shaped annular cavity 9. As evident in particular from FIG. 1C the annular cavity 9 is arranged in a larger recess 14 in the cylinder head 1 so that it forms a circumferential shoulder 15 which also extends into a portion 15' which extends between the face wall 12 and a deflection wall 16 that deflects the microwaves after an entry into the annular cavity 9. In order to form an annular hollow conductor cavity the annular cavity 9 is covered by a flat ring 17 (FIG. 5). This flat ring and an upper edge of the wall forming circumferential bar 10 creates a gap through which the microwaves can propagate into the combustion chamber 2 during its circumferential run through the annular hollow conductor cavity 9. This portion is designated in FIG. 1C with reference numeral 18.

Figure 1B:
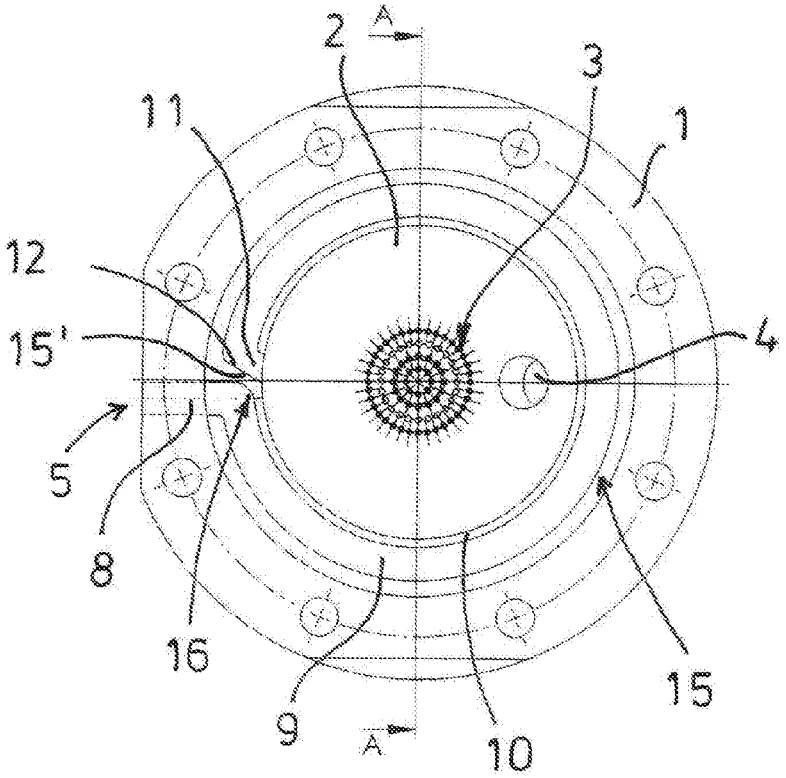
FIG. 1B illustrates the cylinder head of FIG. 1A in a in a top view.
Figure 1C:
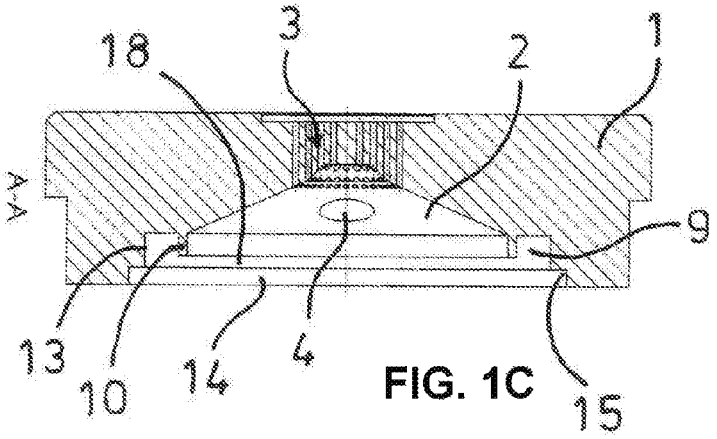
FIG. 1C illustrates the cylinder head of FIG. 1A in a sectional view.
Figure 2A:
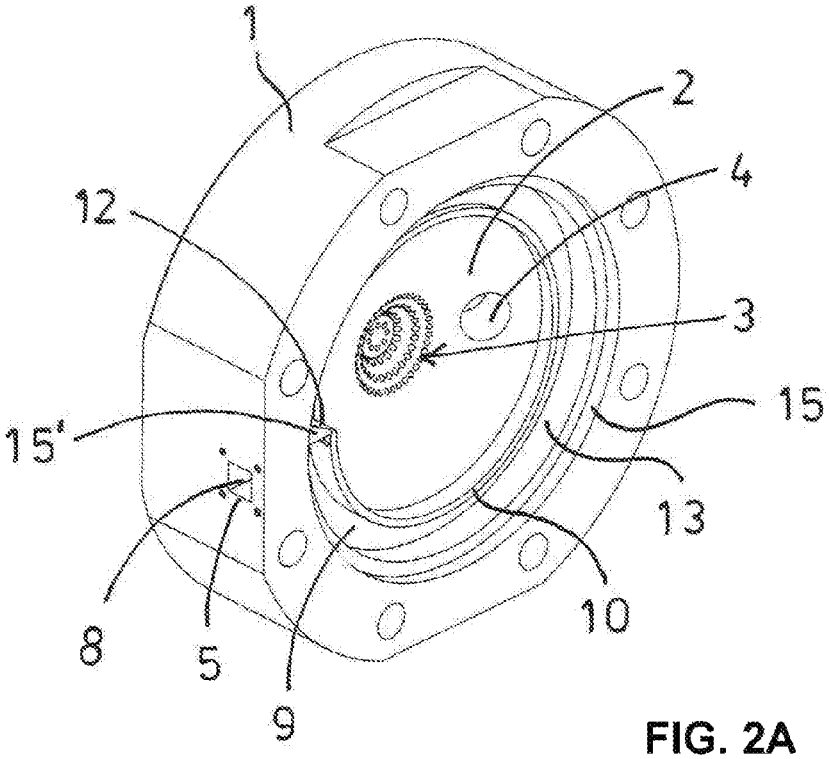
FIG. 2A illustrates a cylinder head with ring injection with an annular gap into the combustion chamber which gap increases in size over a path in a perspective view.
Figure 2B:
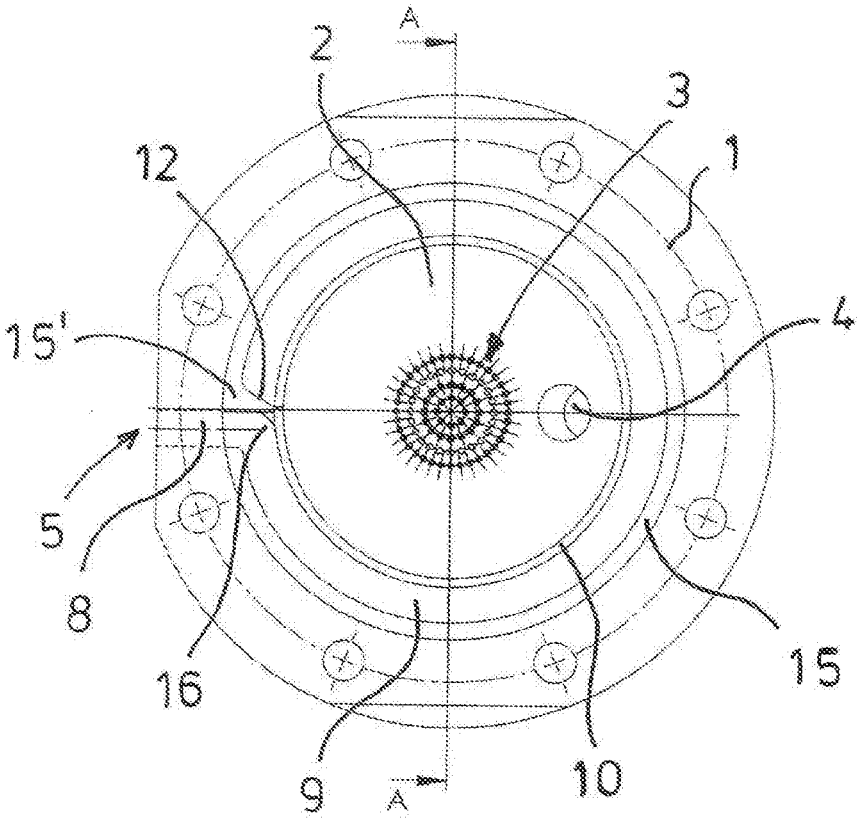
FIG. 2B illustrates the cylinder head of FIG. 2A in a top view.
Figure 2C:
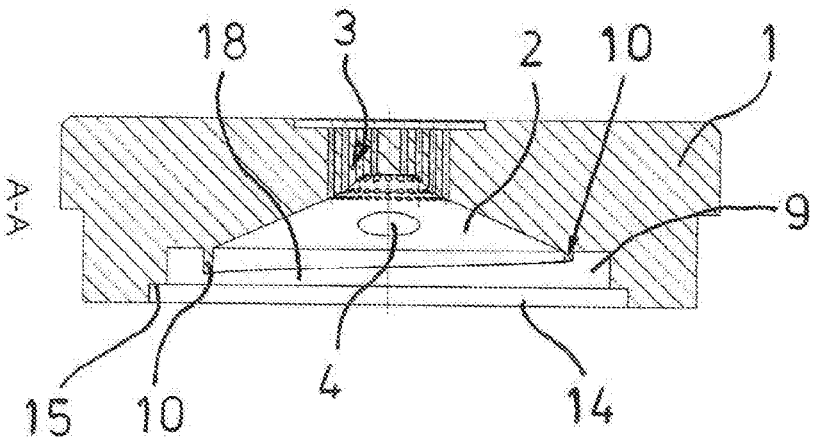
FIG. 2C illustrates the cylinder head of FIG. 2A in a sectional view.
Figure 3A:
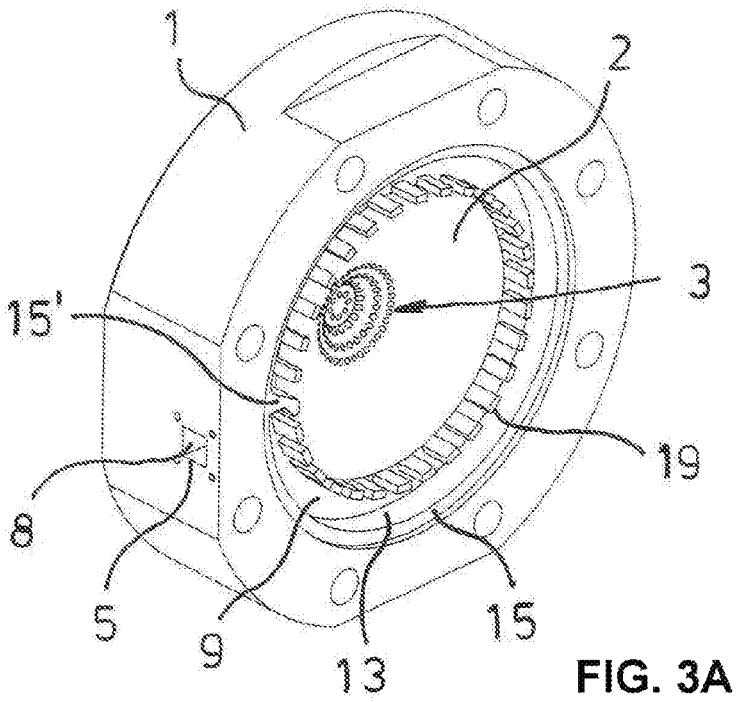
FIG. 3A illustrates a cylinder head with ring injection with a plurality of openings into the combustion chamber in a perspective view.
Figure 3B:
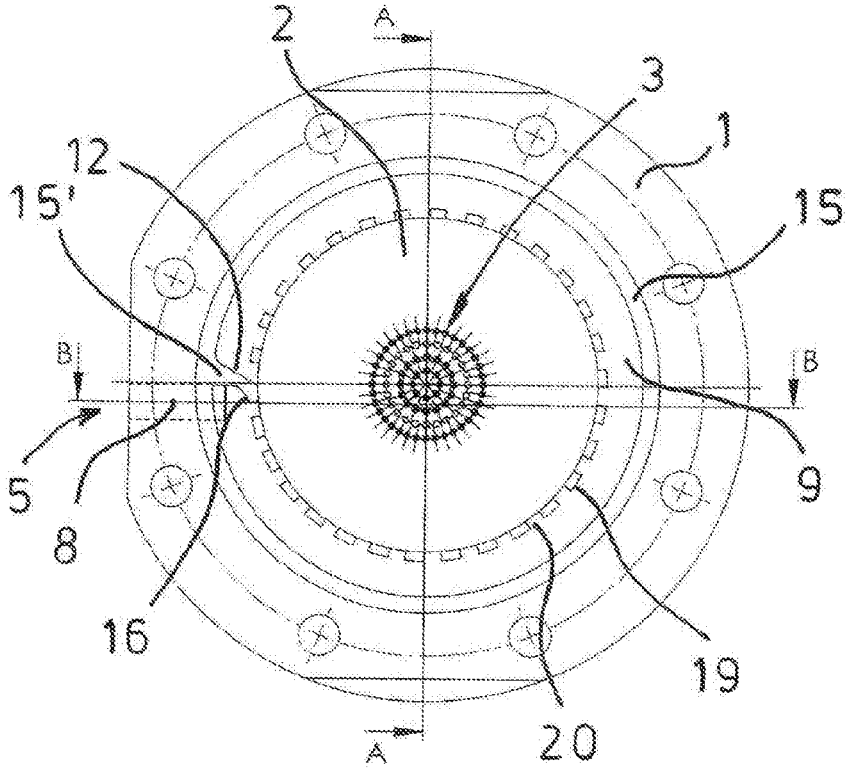
FIG. 3B illustrates the cylinder head of FIG. 3A in a top view.
Figure 3C:
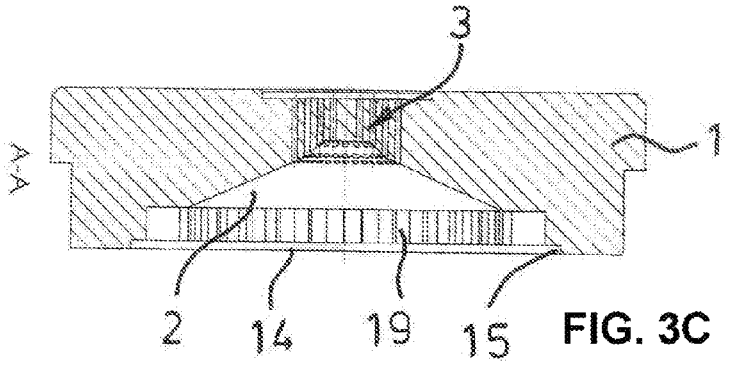
FIG. 3C illustrates the cylinder head of FIG. 3A in a first sectional view.
Figure 3D:
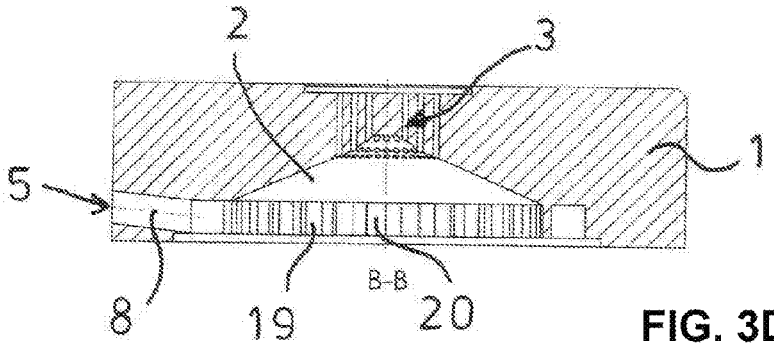
FIG. 3D illustrates the cylinder head of FIG. 3A in a second sectional view offset by 90° relative to the first sectional view, wherein the sectional views also illustrate a detail of the internal combustion engine.
Figure 4A:
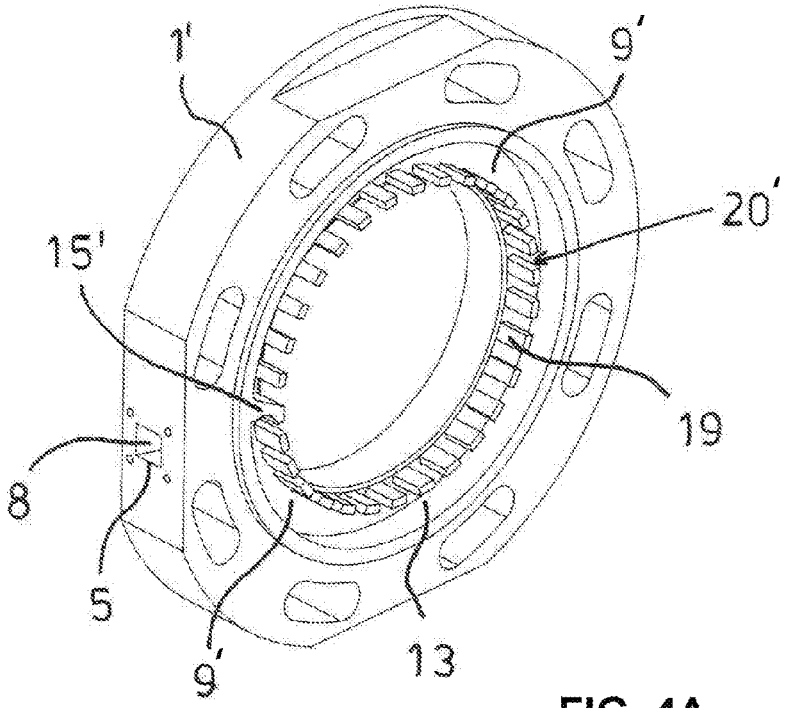
FIG. 4A illustrates a counter piece for a ring injection according to FIG. 3 in a perspective view.
Figure 4B:
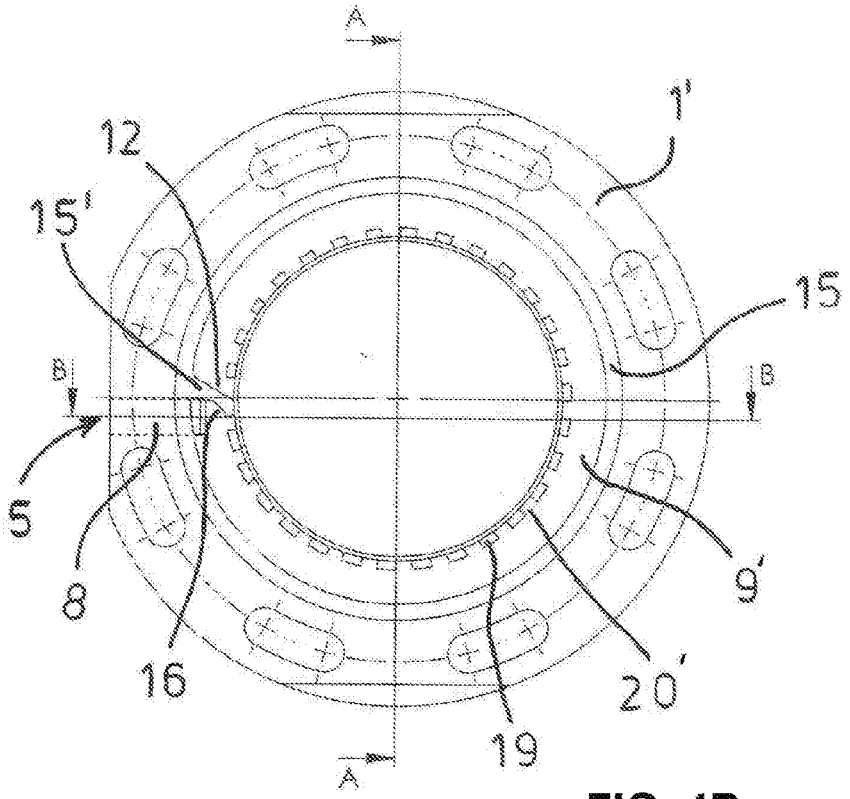
FIG. 4B illustrates the counterpiece according to FIG. 4A in a top view.
Figure 4C:
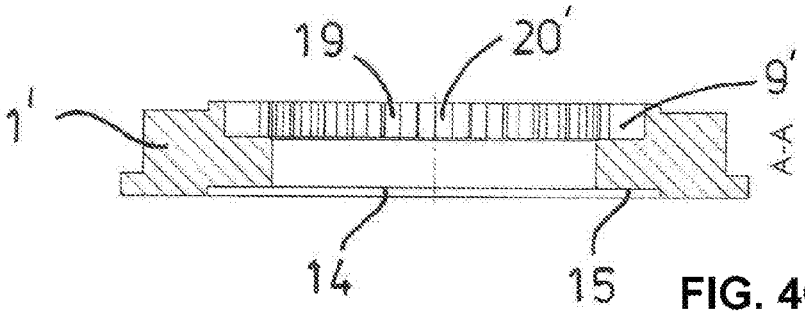
FIG. 4C illustrates the counter piece according to FIG. 4A in a sectional view along the line A-A.
Figure 4D:
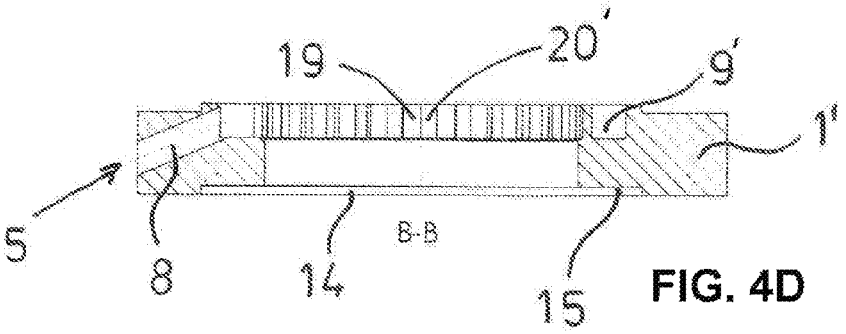
FIG. 4D illustrates the counter piece according to FIG. 4A in a sectional view along the line B-B.

FIG. 2 corresponds to FIG. 1 with the difference that the wall forming bar 10 is continuous, this means at its end proximal to the face wall 12 there is no separate opening. Thus, the bar decreases in height from a beginning of the annular cavity 9 at the deflection wall 16 to and end at the face wall 12 continuously. Also here the annular hollow conductor cavity 9 is formed by a flat ring 17, 17' as illustrated in FIG. 5 or in FIG. 6.

In the embodiment according to FIG. 3 a plurality of individual bars 19 with outlet openings 20 arranged there between is provided instead of a singular wall forming bar. In the embodiment the individual bars 19 have constant height and constant distance. The distance, however, can vary over the length of the annular cavity 9. In this embodiment no bore hole for an additional spark plug is illustrated. FIG. 1B illustrates the cavity 8 which leads into the annular cavity 9. Also here the annular hollow conductor cavity is formed by applying the ring 17 according to FIG. 5 or the ring 17 according to FIG. 6. In FIGS. 3C and 3D the elements illustrated in FIGS. 3A and 3B as far as they are visible are illustrated in cross section.

FIG. 4 illustrates a cylinder head counter piece 1 which is essentially configured according to the cylinder head 1 in FIG. 3 with the difference that the opposite piece is configured as a ring with a pass through opening 21 for enlarging the combustion chamber 2 and the pass through of a piston of a reciprocating piston internal combustion engine that is not illustrated in this figure. The annular cavity is designated here in as 9'. This cylinder head counter piece 1' can be attached at the cylinder head 1 according to FIG. 3 in opposite direction, this means so that the opposite bars 19 are oriented towards each other wherein in the recess 14 according to FIGS. 3C and 3D the ring 17 or 17' according to FIGS. 5 and 6 can be inserted as a divider. The respective ring 17 or 17' forms en annular follow conductor cavity in the cylinder head 1 and also in the cylinder head counter piece. The respective ring 17 or 17' contacts the shoulder 15 in the recess 14. This recess is missing in the cylinder head counter piece 1'.

FIG. 5 illustrates a cylinder head 1 according to FIG. 2 with a wall forming bar 10 whose height decreases over the length of the annular cavity 9 with an inserted flat ring 17 which forms an annular hollow conductor cavity 9'.

Figure 6A:
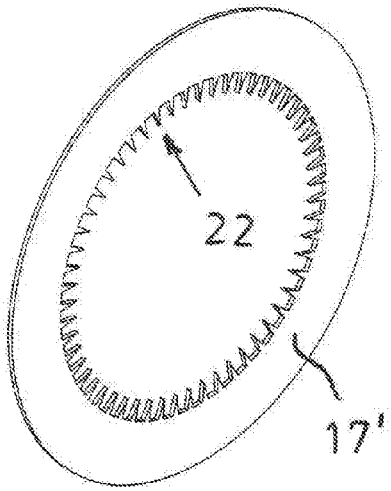
FIG. 6A illustrates a cover ring for forming an annular hollow conductor cavity with additional points in a perspective view.
Figure 6B:
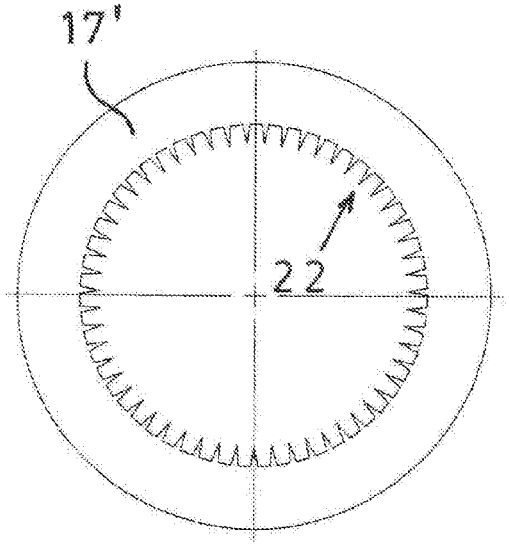
FIG. 6B illustrates the cover ring of FIG. 6A in a top view.
Figure 7A:
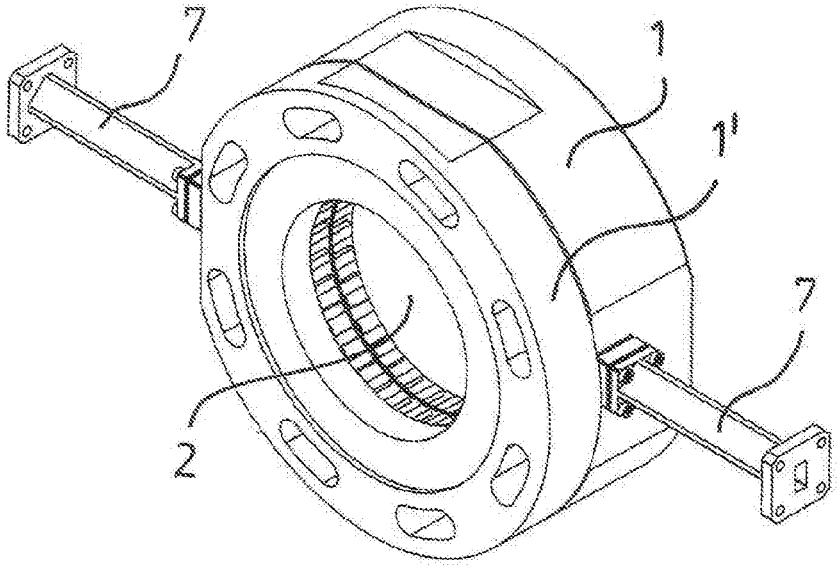
FIG. 7A illustrates cylinder head according to FIGS. 3 and 4 in assembled condition in a perspective view.
Figure 7B:
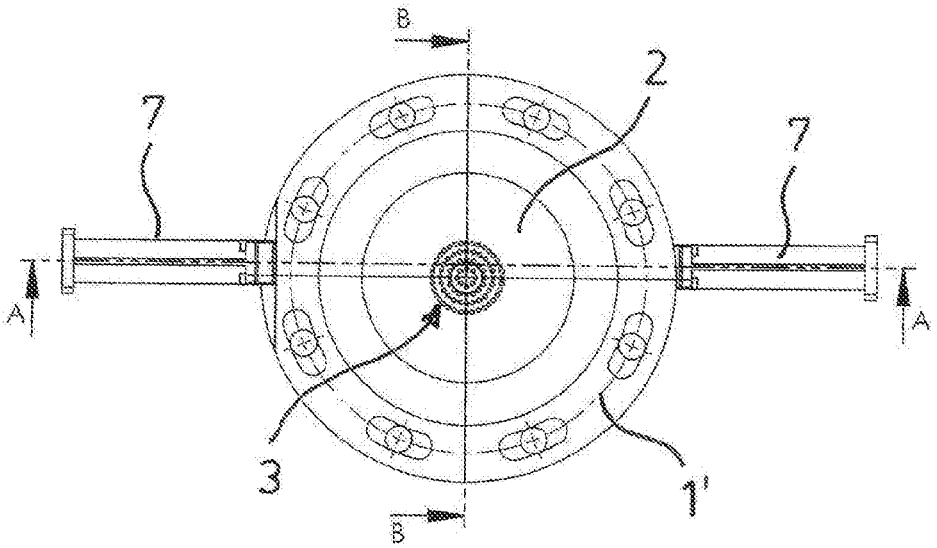
FIG. 7B illustrates the cylinder head according to FIGS. 3 and 4 in assembled condition in a top view.
Figure 7C:
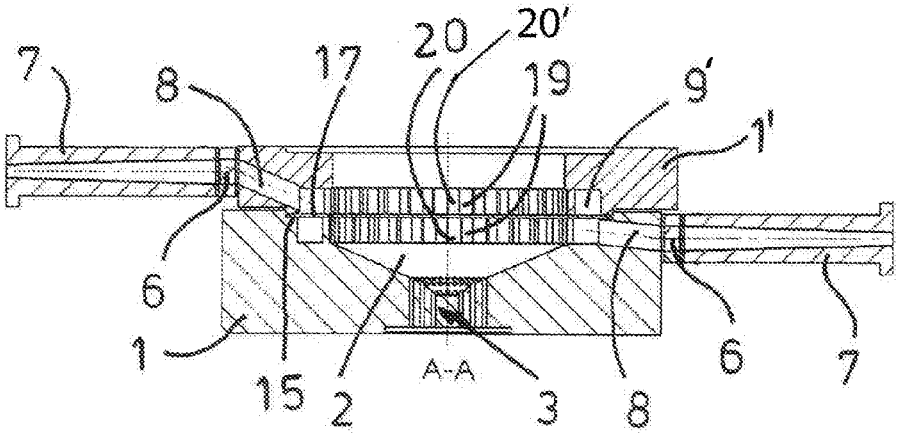
FIG. 7C illustrates the cylinder head according to FIGS. 3 and 4 in assembled condition in a sectional view along the line A-A.
Figure 7D:
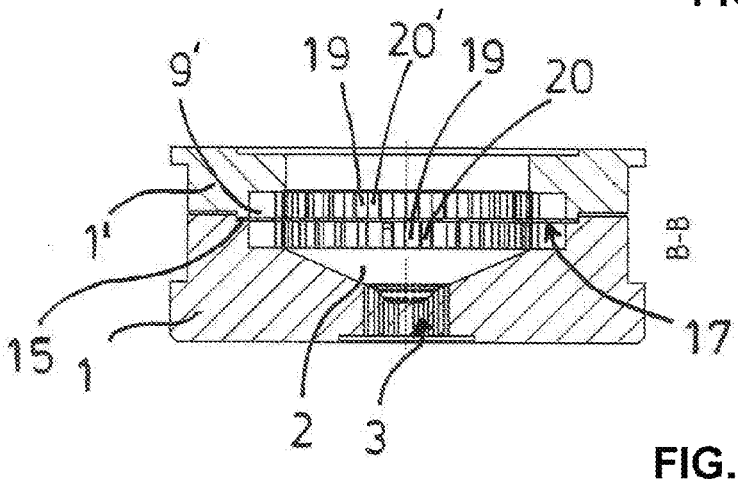
FIG. 7D illustrates the cylinder head according to FIGS. 3 and 4 in assembled condition in a sectional view along the line B-B.

FIG. 6 illustrates a configuration of the ring 17' with ignition points 22 which are oriented in a direction towards a center point of the ring and which generate local field augmentations.

FIG. 7 illustrates an assembly of a cylinder head 1 with a cylinder head counter piece 1' according to FIGS. 3 and 4 with individual bars 19 and a ring according to FIG. 5 for dividing the respective annular hollow conductor cavities 9, 9' in the cylinder head 1 or the cylinder head counter piece 1'. At the cylinder head 1 and the cylinder head piece 1' respective microwave feeds 7 are illustrated which include a microwave window 6 in front of an entry into the opening 5 for the hollow cavity 8. In the embodiment the cylinder head 1 and the cylinder head counter piece 1' are arranged at one another so that the microwave feeds 7 are arranged exactly opposite to each other. It is certainly feasible to select another arrangement through rotation as a function of requirements for a respective application.

Figure 8:
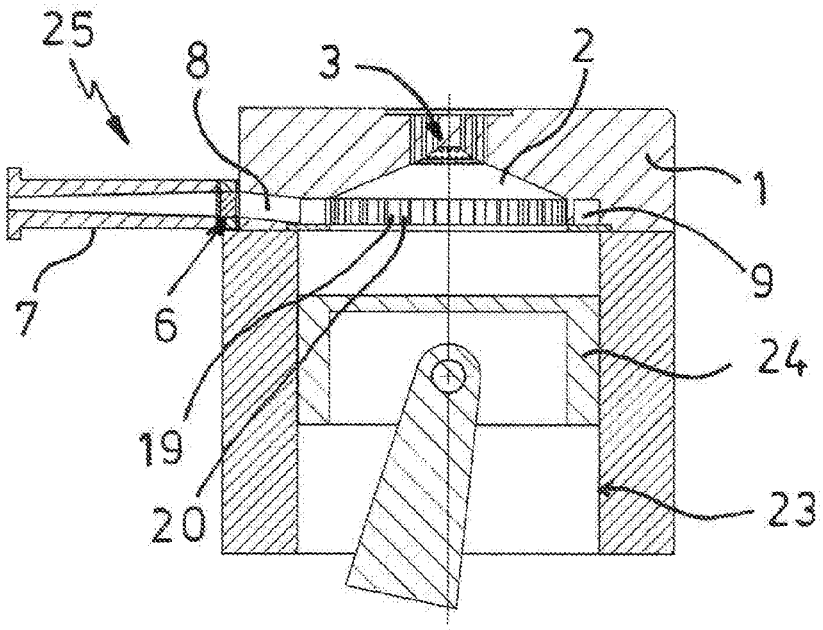
FIG. 8 illustrates a cross section through a detail of an internal combustion engine with a cylinder with a ring injection in the embodiment according to FIG. 3.

FIG. 8 schematically illustrates a detail of a reciprocating piston, internal combustion engine 25 with a cylinder 23 in which a piston 24 is moveable with a cylinder head in which an annular cavity 9 with individual bars 19 according to FIG. 3 is arranged for microwave ring injection. This figure also illustrates the microwave feed 7 with microwave windows 6 illustrated in FIG. 7.

As recited supra individual features in respective embodiments can be combined with other features of another embodiment when this is useful. As apparent from the FIGs the cylinder head 1 is a component that can be produced in a simple manner wherein the annular hollow conductor cavity 9 is formed by inserting a respective ring 17 or 17'. The respective ring 17 or 17' is used as a divider wall for a cylinder head counter piece 1'.

The cylinder heads 1 are made from a typical material, typically metal, wherein the material can be selected according to the application. The boundary for the microwaves in the illustrated hollow conductor cavities is certainly made from metal, wherein additional measures can be taken in order to optimize conductivity, for example by surface coating with a highly electrically conductive material.

What is claimed is:

1. A method for injecting microwave energy into a combustion chamber of a reciprocating piston internal combustion engine including at least one cylinder including a cylinder head, the method comprising the steps:

passing the microwaves through a microwave window of the internal combustion engine, wherein the microwave window seals the combustion chamber relative to an external microwave feed outside the cylinder head, and wherein the microwave window is made from a solid microwave permeable material;

running the microwaves about a circumference of a combustion chamber through an annular hollow conductor cavity which is configured as a channel that is arranged in the cylinder head and that extends about the combustion chamber after passing the microwaves through the microwave window; and radially injecting the microwaves into the combustion chamber after running the microwaves about the circumference of the combustion chamber.

2. The method according to claim 1, wherein the microwaves are injected into the combustion chamber through at least one annular hollow conductor cavity including a bar that envelops the combustion chamber and forms a wall of the at least one annular hollow conductor cavity towards the combustion chamber and including at least one outlet opening oriented towards the combustion chamber.

3. The method according to claim 2, wherein the microwaves are injected into the combustion chamber at an angle at an end of the at least one annular hollow conductor cavity.

4. The method according to claim 2, wherein the microwaves are injected from the at least one annular hollow conductor cavity through a gap circumferentially extending between the at least one annular hollow conductor cavity and the combustion chamber wall, or through a gap circumferentially extending between the at least one annular hollow conductor cavity and the combustion chamber wall and increasing in size with a length of a path of the microwave in the at least one annular hollow conductor cavity, or through a plurality of gaps arranged between the at least one annular hollow conductor cavity and the combustion chamber wall perpendicular to a propagation direction of the microwave and increasing in size with a length of a path of the microwave in the at least one annular hollow conductor cavity, or through a combination thereof.

5. The method according to claim 1, wherein the microwaves are injected with a frequency of 25 GHz to 90 GHz.

6. The method according to claim 1, wherein the microwaves are injected in impulse packets, and wherein the impulse packets are maintained after an ignition of a fuel air mix has already been provided.

7. The method according to claim 1, wherein the microwaves are injected as a function of an angle of a crank shaft.

8. A device for injecting microwave energy into a combustion chamber of an internal combustion engine, comprising:

at least one cylinder with a cylinder head and a combustion chamber, wherein microwaves are injected through a microwave window into the combustion chamber, wherein the cylinder head includes at least one circumferential annular hollow conductor cavity circumferentially extending about the combustion chamber and including at least one feed for the microwaves and at least one outlet opening for the microwaves arranged between the at least one circumferential annular hollow conductor cavity and the combustion chamber.

9. The device according to claim 8, wherein a wall oriented at an angle relative to the at least one circumferential annular hollow conductor cavity and an outlet opening oriented in a direction towards the combustion chamber are arranged at an end of the at least one circumferential annular hollow conductor cavity.

10. The device according to claim 8, wherein a gap is provided circumferentially extending between the at least one circumferential annular hollow conductor cavity and the combustion chamber wall, or a gap is provided circumferentially extending between the at least one circumferential annular hollow conductor cavity and the combustion chamber wall and increasing in size with a length of a path of the microwaves in the at least one circumferential annular hollow conductor cavity, or a plurality of gaps is provided between the at least one circumferential annular hollow conductor cavity and the combustion chamber wall perpendicular to a propagation direction of the microwaves and advantageously increasing in size with a length of a path of the microwaves in the at least one circumferential annular hollow conductor cavity, or a combination thereof is provided.

11. The device according to claim 8, wherein the at least one circumferential annular hollow conductor cavity is configured as a channel extending about the combustion chamber, wherein the channel includes a ring that is insertable onto the channel and includes points protruding into the combustion chamber.

12. The device according to claim 8, wherein an additional annular hollow conductor cavity is provided adjacent to the at least one circumferential annular hollow conductor cavity, and wherein the additional annular hollow conductor cavity includes outlet openings that are offset relative to outlet openings of the at least one circumferential annular hollow conductor cavity.

13. The device according to claim 12, wherein the additional annular hollow conductor cavity is arranged in an annular component which is arranged adjacent to the at least one circumferential annular hollow conductor cavity with the additional annular hollow conductor cavity of the annular component arranged in an opposite direction relative to the at least one circumferential annular hollow conductor cavity wherein an annular flat ring is arranged between the annular component and the at least one circumferential annular hollow conductor cavity, wherein the annular flat ring is provided with points protruding into the combustion chamber, and wherein the annular flat ring forms a divider wall between the additional annular hollow conductor cavity and the at least one circumferential annular hollow conductor cavity, and wherein the annular flat ring simultaneously forms a wall for the additional annular hollow conductor cavity and for the at least one circumferential annular hollow conductor cavity.

14. An internal combustion engine, comprising the device for injecting microwave energy according to claim 8.

* * * * *